United States Patent [19]

Shimada et al.

[11] 4,387,275

[45] Jun. 7, 1983

[54] SPEAKER AND SPEAKER SYSTEM

[75] Inventors: Yasuomi Shimada, Hirakata; Tatsuo Fukuyama, Kyoto; Toshiyuki Mizutani, Neyagawa, all of Japan

[73] Assignee: Matsushita Electric Industrial Co., Ltd., Osaka, Japan

[21] Appl. No.: 285,110

[22] PCT Filed: Nov. 6, 1980

[86] PCT No.: PCT/JP80/00275

§ 371 Date: Jul. 9, 1981

§ 102(e) Date: Jul. 9, 1981

[87] PCT Pub. No.: WO81/01492

PCT Pub. Date: May 28, 1981

[30] Foreign Application Priority Data

| | | | |
|---|---|---|---|
| Nov. 9, 1979 | [JP] | Japan | 54-145870 |
| Nov. 9, 1979 | [JP] | Japan | 54-145871 |
| Jan. 18, 1980 | [JP] | Japan | 55-4902 |
| Jun. 2, 1980 | [JP] | Japan | 55-74817 |

[51] Int. Cl.[3] ..... H04R 7/16

[52] U.S. Cl. ..... 179/115.5 R; 179/115.5 PC; 179/116; 179/115.5 VC; 181/166

[58] Field of Search .... 179/116, 115.5 PC, 115.5 VC, 179/115.5 R, 115.5 BS, 180; 181/166

[56] References Cited

U.S. PATENT DOCUMENTS

| | | | |
|---|---|---|---|
| 2,318,517 | 5/1943 | Olson | 179/115.5 VC |
| 3,772,466 | 11/1973 | Hossbach | 179/116 |
| 4,147,899 | 4/1979 | Mori et al. | 179/116 |
| 4,235,302 | 11/1980 | Tsukamoto | 179/115.5 VC |
| 4,239,090 | 12/1980 | Dahlquist | 179/115.5 VC |
| 4,239,943 | 12/1980 | Czerwinski | 179/115.5 VC |

*Primary Examiner*—G. Z. Rubinson
*Assistant Examiner*—L. Schroeder
*Attorney, Agent, or Firm*—Burgess, Ryan and Wayne

[57] ABSTRACT

A speaker in which a voice coil bobbin (4) is connected through a mechanical filter to vibrating members (11, 14) for limiting the reproducing frequency band in predetermined range by the mechanical filter, and a speaker system employing the speaker. A pneumatic suspension V is used as the mechanical filter to eliminate the variations in the reproducing frequency band even for long term usage.

10 Claims, 15 Drawing Figures

SPEAKER AND SPEAKER SYSTEM

FIELD OF THE INVENTION

The present invention relates to a speaker provided with a mechanical filter and more particularly a speaker in which the filter frequency remains unchanged even after a long time interval of operation and the problems such as the rolling phenomenon and the bottoming of a voice coil bobbin are eliminated and a speaker system which uses the speaker of the type described.

BACKGROUND OF THE INVENTION

In order to limit the acoustic frequencies reproduced by a speaker within a desired range, there has been a universal practice to insert a low-pass filter or a band-pass filter comprising an electronic circuit into the input stage of the speaker, but there has been also devised and demonstrated a speaker of the type in which a mechanical filter is incorporated into the speaker so that the range of reproduced acoustic frequencies may be limited and the characteristics substantially similar to those attained by the insertion of a low-pass filter or a band-pass filter comprising an electronic circuit may be realized. In the latter type speakers, used in general as a mechanical filter is a center holder or retainer made of a phenol-impregnated and corrugated fabric and interposed between a voice coil bobbin and a diaphragm.

When the center holder or retainer has been used for a long time, it is subjected to fatigue so that phenol is broken and consequently the compliance is increased. As a result, the filter characteristics are varied and subsequently the range of reproduced acoustic frequencies is changed.

There has been also devised and demonstrated a speaker of the type which is mounted on a partition wall disposed within a speaker box or cabinet; an air-tight chamber is defined between the speaker box or cabinet and a front plate of the speaker box; and a passive cone is mounted on the front plate, whereby the vibrations of a diaphragm cause the vibrations of the air trapped in the air-tight chamber which in turn cause the passive cone to drive. In this case, the air-tight chamber acts as a mechanical filter, so that a desired range of reproduced acoustic frequencies may be determined by suitably determining the volume of the air-tight chamber.

However, the box of the speaker system of the type described above becomes large in size and the partition plate or wall and the passive cone must be provided in addition to the speaker. As a consequence, there arises the problem that the costs increase.

DISCLOSURE OF THE INVENTION

According to the present invention, an air-tight chamber is defined within a speaker itself and used as a mechanical filter. Therefore, the compliance of the mechanical filter can be made independent on the fatigue of a suspension which constitutes a mechanical filter. It follows, therefore, that even when the fatigue of the suspension should occur, the filter characteristics remain unchanged and consequently the range of reproduced acoustic frequencies remains unchanged. Since the air-tight chamber or space is defined within the speaker itself not in the speaker box or cabinet, the overall system can be made into compact in size and the cost savings can be attained.

The present invention will become more apparent from the following description of embodiments thereof taken in conjunction with the accompanying drawings.

BEST MODE FOR CARRYING OUT THE INVENTION

First Embodiment

Figure 1:
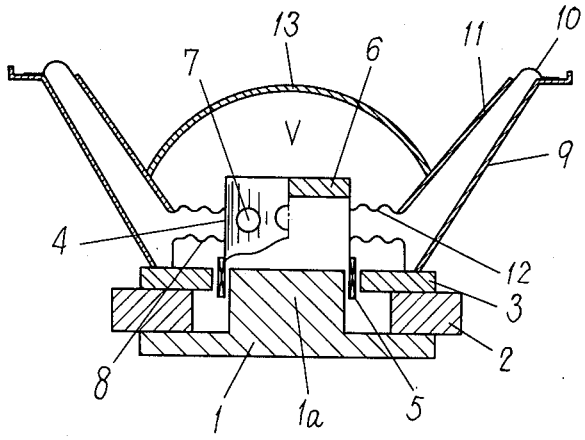
FIG. 1 is a sectional view of a first embodiment of the present invention.

In FIG. 1 is shown the first embodiment of the present invention. A magnet 2 is mounted on a first plate 1 with a center pole 1*a* and a second plate 3 is mounted on the magnet 2. A voice coil 5 is mounted on a voice coil bobbin 4 the upper end of which is air-tightly closed with a cap 6. The periphery cylindrical wall of the voice coil bobbin 4 is formed with a predetermined number of apertures 7. A center holder or spider 8 is made of a phenol-impregnated and corrugated fabric and its inner rim is bonded or otherwise joined to the outer cylindrical wall surface of the voice coil bobbin 4 while its outer rim, to the upper surface of the second plate 3. The upper rim of a truncated-cone-shape diaphragm 11 is bonded or otherwise joined through an edge 10 to the upper rim of a frame 9 which in turn is mounted on the second plate 3. The lower rim of the diaphragm 11 is bonded or otherwise joined to the outer cylindrical wall surface of the voice coil bobbin 4 through a suspension 12 made of a phenol-impregnated and corrugated fabric. The diaphragm 11 is partially covered with a dust cap 13. The space V defined by or surrounded with the voice coil bobbin 4, the cap 6, the diaphragm 11, the suspension 12 and the dust cap 13 is made air-tight so that no air leaks to the exterior. That is, an air-tight chamber is formed.

With the construction described above, the air-tight chamber operates as an air suspension and subsequently functions as a mechanical filter, whereby the reproduced acoustic frequencies may be limited or confined within a desired range. That is, when the signals with low frequencies are applied, the voice coil bobbin 4 is caused to vibrate gently and the air-tight chamber V responds to the vibrations of the bobbin 4, whereby the vibrations of the bobbin 4 can be transmitted to the diaphragm 11. However, when the signals with too high frequencies are applied, the bobbin 4 is caused to vibrate vigorously, so that the air-tight chamber V cannot follow its vibrations and consequently the vibrations of the bobbin 4 cannot be transmitted to the diaphragm 11. Thus, the air-tight chamber V serves to restrict the reproduced acoustic frequencies to a predetermined range.

According to the first embodiment, it is not needed to incorporate a mechanical filter within a loudspeaker, so that the overall system can be made compact in size and subsequently the cost savings can be attained.

The compliance of the air trapped in the air-tight chamber V is given by Eq. (1)

$$C = \frac{V}{\rho c^2 S^2} \quad (1)$$

where $\rho$: the density of air, c: the speed of sound,

S: The effective vibration surface of the suspension 12 including the voice coil bobbin 4; and V: the volume of the air-tight chamber.

The effective vibration surface S is given by Eq. (2)

$$S = \frac{\pi}{3}(R^2 + rR + r^2) \quad (2)$$

where

R: the radius of the suspension 12, and r: the radius of the voice coil bobbin 4.

From Eqs. (1) and (2) it is apparent that the compliance C of the air is only dependent upon the radius R of the suspension 12 and is made independent of the fatigue of the suspension 12. It follows, therefore, that the filter frequency which is dependent upon the compliance C of the air and the masses of the diaphragm 11 and the voice coil bobbin 4 remains unchanged independently on the fatigue of the suspension 12.

The variations in the compliance C of the air are dependent upon the dimensional accuracies of the volume V of the air-tight chamber and the effective vibration surface S of the suspension 12 as is clear from Eq. (1). As a result the fabrication of the speakers in accordance with the present invention may be much facilitated as compared with the fabrication of the prior art speakers in which variations in compliance of mechanical dampers made of a phenol-impregnated and corrugated fabric are dependent upon the concentration of phenol and the molding temperatures and times.

Instead of the suspension 12 of the type shown in FIG. 1, any other suitable elastic member may be used, but it must be not permeable to the air. In addition, it is not needed that the chamber V is completely air-tight, but it is to be understood that it may have a small pin hole and that it suffices that the chamber is substantially maintained air-tight.

Second Embodiment

Figure 2:
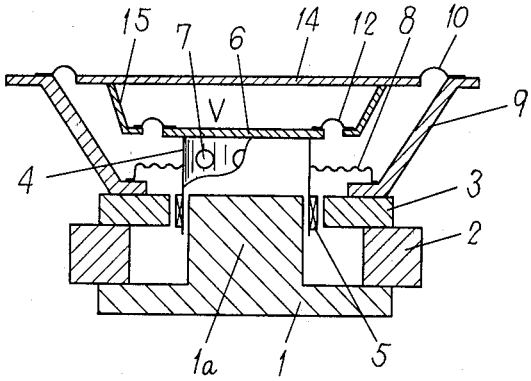
FIG. 2 is a sectional view of a second embodiment of the present invention.

In FIG. 2 is shown the second embodiment of the present invention. Those parts whose functions are similar to those of the parts shown in FIG. 1 are designated by similar reference numerals and no explanation of similar parts shall be made. A flat diaphragm 14 is mounted on the circular upper rim of an adapter 15 whose lower rim or radially inwardly extended flange is bonded or otherwise joined to the cap 6 of the voice coil bobbin 4 through the suspension 12.

According to the second embodiment, therefore, the space or chamber V defined by the flat diaphragm 14, the adapter 15, the suspension 12 and the cap 6 becomes air-tight, so that no air leaks to the exterior. That is, an air-tight chamber is formed. The air-tight chamber acts as an air suspension and subsequently as a mechanical filter, whereby the reproduced acoustic frequencies may be confined within a desired range. As with the first embodiment shown in FIG. 1, the compliance C of the air entrapped in the air-tight chamber V is independent on the fatigue of the suspension 12, so that the filter characteristics remain unchanged even after a long time period of service.

In FIG. 2, the cap 6 is shown as having a diameter greater than that of the upper end opening of the bobbin 4 so that the inner rim of the damper or suspension 12 is bonded or otherwise joined to the cap 6, but it is to be understood that as with the first embodiment, the cap 6 may be air-tightly fitted into the upper opening of the voice coil bobbin 4 and the inner rim of the suspension 12 may be bonded or otherwise joined to the outer cylindrical wall surface of the voice coil bobbin 4.

In both the first and second embodiments shown in FIGS. 1 and 2, respectively, when the upper end of the voice coil bobbin 4 is air-tightly closed, the lowest resonant frequency of the speaker rises. It is, therefore, preferable that apertures 7 of a suitable diameter are perforated through the cylindrical wall of the voice coil bobbin 4 at suitable positions. The positions and effects of the apertures 7 will be described in more detail below.

Figure 3:
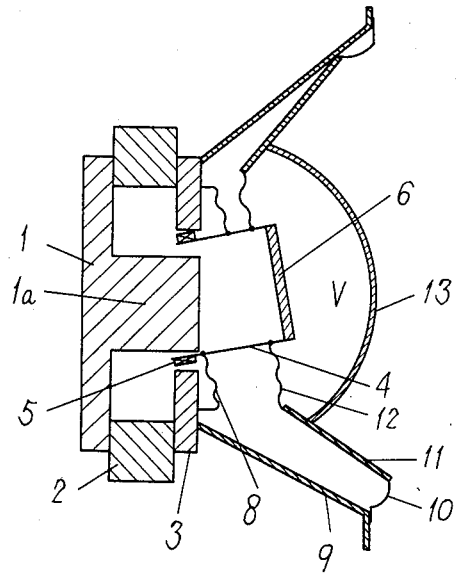
FIGS. 3 through 6, inclusive, are sectional views used for the explanation of the rolling phenomenon.

When the speaker with the mechanical filter of the type described with reference to FIG. 1 or 2 is mounted on a baffle plate in a speaker box or cabinet and the box or cabinet is so positioned that the axis of the voice coil bobbin 4 is extended horizontally as shown in FIG. 3, distortions of the diaphragm 11 and the bobbin 4 result due to the weight of the diaphragm 11, so that the width f the gap between the bobbin 4 and the center pole 1*a* of the plate or between the voice coil 5 and the plate 3 is varied in the circumferential direction of the gap.

When the speaker is driven under these conditions, rolling occurs due to the discrepancy between the center of gravity and a supporting point. As a result, the so-called "gap rubbing" phenomenon that the bobbin 4 and the center pole 1*a* or the voice coil 5 and the second plate 3 rub against each other in the narrowed gap will follows. As a result, noise and distortions occur.

In order to overcome this problem, there may be proposed to provide a gap with a greater width, but there immediately arises another problem that the magnetic flux density drops and consequently the efficiency of the speaker is reduced.

Figure 4:
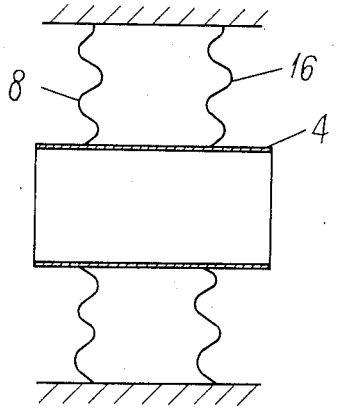

To solve this problem, there has been proposed a scheme as shown in FIG. 4. That is, an additional corrugated damper 16 is added so that the voice coil bobbin 4 may be suspended by two dampers 8 and 16. This construction will be referred to as "the double-damper suspension" in this specification for brevity hereinafter. With this construction, the distance between the dampers 8 and 16 becomes an arm of a moment and the spring constant in the displacement in the radial direction of the dampers becomes large. Therefore, as compared with a moment produced by the displacement of one damper, a greater moment can be generated, so that the rolling phenomenon can be considerably suppressed.

Figure 5:
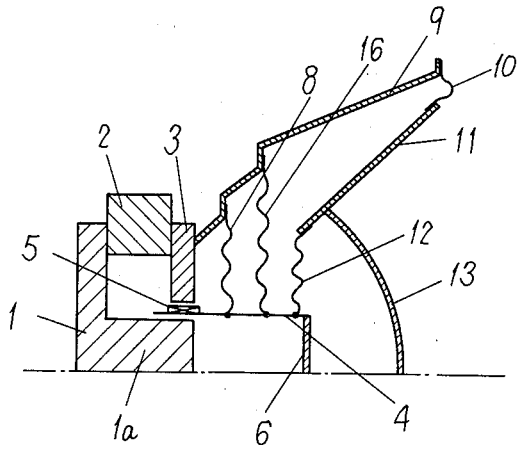
Figure 6:
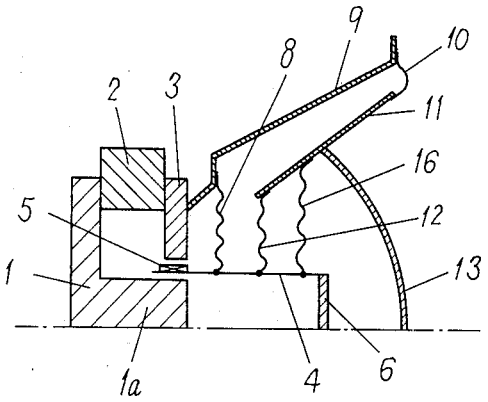

Two of the actual designs of the "double-damper suspension" are shown in FIGS. 5 and 6, respectively. In FIG. 5, an additional or second damper 16 is used as a damper per se and is interconnected together with the damper 8 as shown in FIG. 1 between the bobbin 4 and the frame 9 (or the second plate 3). In FIG. 6, the second damper 16 is used as a mechanical filter and is interconnected together with the suspension 12 shown in FIG. 1 between the bobbin 4 and the diaphragm 11. Of course, a damper or mechanical filter in double construction may be used, but it becomes complex in construction and subsequently the costs increase, so that it is not advantageous in practice.

Figure 7:
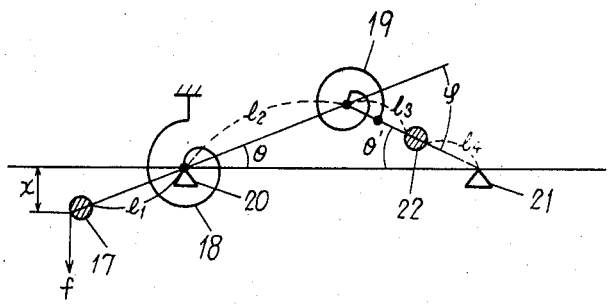
FIG. 7 is a schematic view showing the dynamic correlation among the parts of the speakers shown in FIGS. 5 and 6.

The dynamic analysis of the speaker of the type shown in FIG. 5 or 6 may be made with reference to FIG. 7. Reference numeral 17 represents the mass of the voice coil; 18 and 19, coiled springs which correspond to the damper and mechanical filter, respectively; 20 and 21, pivot points; 22, the mass of the diaphragm; $l_1$, the distance between the mass 17 and the pivotal point 20; $l_2$, the distance between the pivotal point 20 and the coiled spring 19; $l_3$ and $l_4$, the distances obtained by dividing the distance between the coiled spring 19 and the pivotal point 21 at the center of gravity of the mass 22; $\theta$, $\theta'$ and $\psi$, the angular displacements when the external force f acts on the mass 17 of the voice coil; and x, the displacement of the mass 17 when the external force f acts on it. The spring 18 corresponds to the combination of the dampers 8 and 16 shown in FIG. 5 or to the damper 8 shown in FIG. 6 while the spring 19, to the damper 12 shown in FIG. 5 or to the combination of the dampers 12 and 16 shown in FIG. 6.

The moments of the springs 18 and 19 are given by $$M = K_1 \times \theta, \text{ and}$$

$$M = K_2 \times \psi$$

where $K_1$ and $K_2$ are the spring constants of the springs 18 and 19, respectively and $\theta$ and $\psi$ are the angular displacements. With the spring constants $K_1$ and $K_2$ as defined above, the displacement x of the mass 17 when the external force f acts on it is given by Eq. (3)

$$x = \frac{l_1^2 f}{K_1 + K_2\left(1 + \frac{l_2}{l_3 + l_4}\right) + \alpha} \tag{3}$$

where $$\alpha = j\omega R_1 l_1 - j\omega R_2 \frac{l_3 + l_2 + l_4}{l_3 + l_4} - l_1 m_1 \omega^2 - \frac{l_2^2(j\omega R_3 - l_4 m_2 \omega^2}{(l_2 + l_4)(l_3 + l_4)} \tag{4}$$

$R_1$: the mechanical resistance of the spring 18,
$R_2$: the mechanical resistance of the spring 19,
$m_1$: the mass of the voice coil 17,
$m_2$: the mass of the diaphragm 22, and
$\psi$: the angular frequency of vibration The displacement x becomes maximum when the angular frequency reaches a resonant frequency $\omega_o$, and in this case, the factor of sharpness of resonance Q is given by $$Q = \frac{\omega_o M}{R} = \frac{\frac{1}{2\pi\sqrt{MC}} \times M}{R} = \frac{\frac{1}{2\pi}\sqrt{\frac{M}{C}}}{R} \tag{5}$$

where

R: the mechanical resistance of a material,
M: the mass of a vibration system, and
C: the compliance of the vibration system.

From Eq. (5) it is seen that in the speakers having the same parameters C, M and R, the quality factor Q is not dependable on the resonant angular frequency $\omega_o$; that is, Q does not vary with variations in $\omega_o$. Therefore, the term containing $\omega$ in Eq. (3); that is, $\alpha$ given by Eq. (4) may be regarded as a constant.

It follows, therefore, that from Eq. (3)the greater the spring constants $K_1$ and $K_2$ become independently of each other, the higher the resistance against distortions due to the rolling becomes.

It is apparent that the longer the distance $l_2$, the better, but the increase in $l_2$ results in the increase in length of a spacer and the decrease in strength of the bobbin, so that, in practice, the increase in length $l_2$ is limited; that is, the length $l_2$ cannot be increased indefinitely. It is also apparent that the shorter the distance $(l_3+l_4)$, the better the results become. However, as long as a cone-shaped diaphragm is used, the distance $(l_3+l_4)$ cannot be made zero because of the discrepancy or difference between the position of the spring 19 corresponding to the mechanical filter, the pivotal point 21 corresponding to the edge and the position of the mass 22 of the diaphragm. Thus, there exists a limit to the decrease in the displacement x given by Eq. (3).

In the design and construction of a speaker which uses the mechanical filter of the type described previously and which is exclusively used for the reproduction of low acoustic frequencies, it is preferable that the lowest resonant frequency be as low as possible and a higher degree of efficiency be attained. To this end, the weight of a diaphragm used must be as heavy as possible and the magnetic gap must be as narrow as possible. However, the rolling and "gap rubbing" problems arise because the torsion or distortion of the bobbin is enhanced due to the heavy weight of the diaphragm and further because the gap is narrow. In order to satisfy the above-described conditions or criteria, the torsion of the diaphragm as shown in FIG. 3 must be further reduced. It follows, therefore, that the conditions or criteria can be hardly met with the construction as shown in FIG. 5 or 6.

Figure 8:
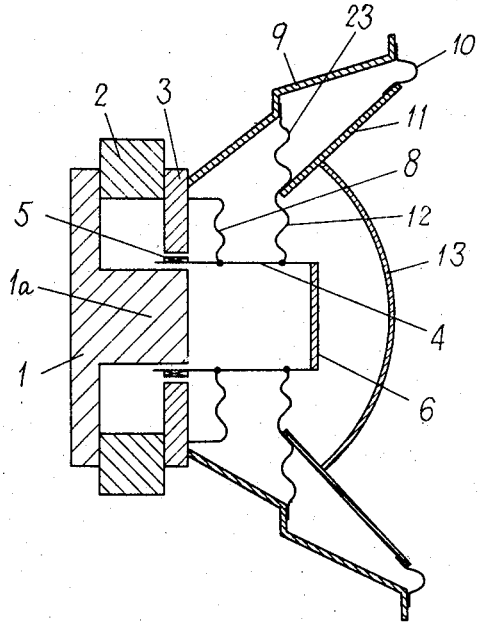
FIG. 8 is a sectional view of a third embodiment of the present invention.

In view of the above, the present invention further provides the third embodiment as shown in FIG. 8 which has a mechanical filter and in which the rolling can be reduced to a minimum; no noise is generated due to "gap rubbing" when driven in a low acoustic frequency range with greater amplitudes; the magnetic flux density is increased; and the driving with a higher degree of efficiency is possible. Those parts whose functions are similar to those of the parts shown in FIGS. 1 through 6 are designated by similar reference numerals and no explanation thereof shall be made. In the third embodiment, a second damper 23 is interconnected between the diaphragm 11 and the frame 9.

The third embodiment with the construction as shown in FIG. 8 exhibits the operating characteristics, mass-productivity and frequency-response characteristic by far superior to those attainable with the speaker of the type shown in FIG. 5 or 6. The operating or dynamic characteristics, mass-productivity and frequency-response characteristics of the first through third embodiments of the present invention will be described in detail below in comparison with those of the speaker as shown in FIG. 5 or 6.

(a) Operating or Dynamic characteristics:

Prior to the description of these characteristics, the modes of operation of the speakers shown in FIGS. 5 and 6 will be described qualitatively so that the difference between them may be pointed out more specifically.

The moment $\mu$ is given by $$\mu = I \cdot \frac{d^2\theta}{dt^2}$$

where

I is an inertia, and $\theta$ is an angular displacement.

Thus, the moment $\mu$ is proportional to the inertia I. If dm is the mass of an elementary particle of a rotating body at a distance r from the axis of rotation thereof, the inertia is given by $$I = \int r^2 dm \quad (6)$$

In the speaker as shown in FIG. 5, the bobbin 4 is supported by the dampers 8 and 16 so that the bobbin 4 is caused to rotate substantially about the midpoint between the dampers 8 and 16.

The distance between the center of gravity of the diaphragm 11 and the midpoint between the dampers 8 and 16 is longer than the distance between the center of gravity of the voice coil 5 and the midpoint between the dampers 8 and 16 and the mass of the diaphragm is about ten times as great as that of the voice coil 5. Therefore, the inertia of the diaphragm 11 given by Eq. (6) is greater than that of the voice coil 5. As a result, the rolling of the diaphragm 11 occurs first due to the moment acting thereon and the vibrations caused by rolling are transmitted to the bobbin 4 through the damper 12 which is a mechanical filter. In this case, since the distance between the center of gravity of the diaphragm 11 and the midpoint between the dampers 8 and 16 is long, the moment is great so that the "gap rubbing" of the voice coil 5 occurs.

In the case of the speaker as shown in FIG. 6, the diaphragm 11 and the bobbin 4 are interconnected to each other with the suspension 12 and the second damper 16 and the distance between the center of gravity of the diaphragm 11 and the midpoint between the suspension 12 and the second damper 16 is short so that the inertia is small. Therefore, both the bobbin 4 and the diaphragm 11 exhibit strong resistance to the torsion as shown in FIG. 2. If the suspension 12 and the damper 16 are held and the spring constants in the case of torsions are sufficiently high, the speaker shown in equivalent to a conventional speaker in which the diaphragm 11 and the bobbin 4 are directly interconnected.

Therefore, it may be said that the speaker as shown in FIG. 6 exhibits higher resistance to rolling than the speaker as shown in FIG. 5. This fact is also understood from the fact that since the coefficient $[(1+l_2/(l_2+l_4)]$ of $K_2$ in Eq. (3) is greater than unity, the denominator of Eq. (3) becomes greater when $K_2$ is greater rather than $K_1$ is increased and consequently the displacement x is decreased.

In the speaker shown in FIG. 6, the suspension 12 and the second damper 16 which function as the mechanical filters are soft, so that the resistance to rolling is weaker than that of the conventional speakers.

On the other hand, in the third embodiment of the present invention as shown in FIG. 8, the second damper 23 interconnects between the frame 9 and the diaphragm 11, so that the distance between the center of gravity of the diaphragm 11 and the center of rolling thereof is short. As a result, the inertia given by Eq. (6) becomes small, so that the rolling is reduced proportionally. In general, the weight of the diaphragm 11 is a few times as heavy as that of the voice coil 5. It follows, therefore, that it is more advantageous to support the diaphragm 11 at the position closer to the center of gravity thereof as shown in FIG. 8 than to support it with the "double-damper suspension" at the position away from the center of gravity as shown in FIG. 5. Thus, it is apparent that the third embodiment shown in FIG. 8 has a higher degree of resistance to rolling.

In the third embodiment as shown in FIG. 8, the diaphragm 11 is supported by the "double-damper suspension" comprising the edge 10 and the second damper 23, so that flexure or deformation of the diaphragm 11 may be avoided. As a consequence, the bobbin 4 is prevented from being twisted, so that no variation in width of the gap will result. This means that it is not needed at all to increase the magnetic gap so as to prevent the "gap rubbing". Consequently, the present invention may provide a speaker with a high magnetic flux density and a higher degree of efficiency.

The suspension 12 which is a mechanical filter is supported by the second damper 23, so that even a slight rolling of the diaphragm 11 will cause any adverse effect on the bobbin 4.

In addition, the suspension 12, the second damper 23 and the first damper 8 constitute a "double-damper suspension" for the bobbin 4, so that its flexure and rolling may be substantially suppressed.

As described above, according to the third embodiment as shown in FIG. 8, three supporting dampers 8, 10 and 23 except the suspension 12 which is a mechanical filter provide two "double-damper suspensions" for the diaphragm 11 and the bobbin 4. As a result, the displacements of the bobbin 4 in the directions except the directions of vibrations thereof can be substantially suppressed. Even when such displacements should occur, the bobbin 4 is exerted with forces due to the moments which in turn are dependent on the lengths of the arms which are the distances between the dampers 8, 10 and 23 respectively and their spring constants in their radiation direction. The lengths of the arms and the spring constants are by far greater than those attainable with the speaker as shown in FIG. 5 or 6. As a result, the displacements in the unwanted directions of the bobbin 4 can be substantially suppressed, so that there may be provided a speaker with a minimum degree of rolling and "gap rubbing".

Figure 9:
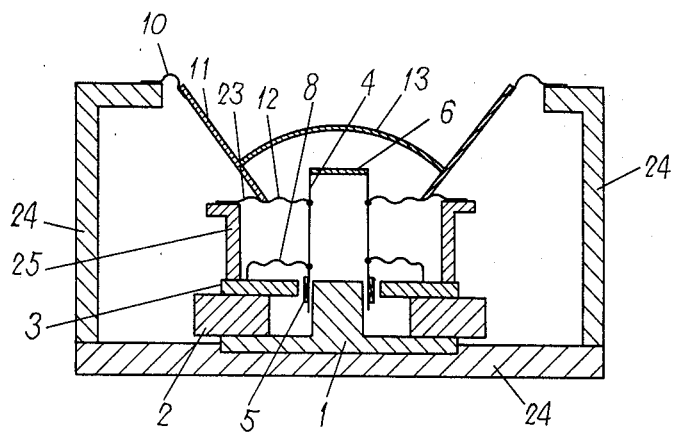
FIG. 9 is a sectional view of a fourth embodiment of the present invention.

In the fourth embodiment as shown in FIG. 9, the wall of an enclosure 24 is used as the frame 9 of the third embodiment shown in FIG. 8. That is, the front or upper rim of the diaphragm 11 is secured to the enclosure 24 itself through the edge 10. Rolling and "gap rubbing" can be also substantially suppressed.

When a speaker is disposed in an enclosure, there arises the problem that the wall surfaces of the enclosure are distorted or deformed when impacts are exerted thereto or when the enclosure is repeatedly dampened and dried. Therefore, if the vibration system as shown in FIG. 6 is disposed within an enclosure in such a way that the bobbin 4 and the diaphragm 11 are suspended from the enclosure only with the damper 8 and the edge 10, respectively, the dimensions or sizes of the wall which corresponds to a baffle plate and the wall upon which is mounted the first plate 1 change due to the distortions or deformations of the enclosure, so that the bobbin 4 is displaced relative to the magnetic gap and subsequently "gap rubbing" occurs immediately.

However, according to the fourth embodiment as shown in FIG. 9, a damper support 25 is mounted on the second plate 3 and a second damper 23 interconnects between the lower rim of the diaphragm 11 and the upper rim or flange of the damper support 25. Therefore, the "double-damper suspension" comprising the first damper 8 and the suspension 12 which is a mechanical filter is provided for the bobbin 4 and the "double-damper suspension" comprising the edge 10 and the second damper 23 is provided for the diaphragm 11. As a result, the displacements of the bobbin 4 due to the distortions or deformations of the enclosure 24 can be substantially eliminated and the distortions or deformations of the enclosure 24 are substantially absorbed by the edge 10. If the bobbin 4 is displaced from its initial position, noise due to the "gap rubbing" is immediately generated as described previously, but the deformations of the edge 10 are hardly observed from the exterior and will not cause any adverse effect on the performance of the speaker. Thus, the present invention is also advantageous when applied to a speaker housed in an enclosure.

(b) Mass-Productivity:

In general, the assembly of speakers includes a relatively large number of bonding steps. Therefore, the faster the curing time of an adhesive used, the higher productivity becomes. However, there is the problem that the adhesives with a shorter curing or setting time such as the so-called "instant" adhesives do not exhibit a high bond strength. In general, the bond-strength values are in proportion to the bond-surface areas, so that the larger the bond surface, the better. Because of the above-described reasons, it is very difficult to increase the speaker assembly productivity.

In the assembly of the speaker of the type as shown in FIG. 5 or 6, the center pole 1, the magnet 2, the plate 3, the bobbin 4, the voice coil 5 and the damper 8 are assembled into a sub-assembly or a field system in a preliminary step and in the final assembly line, the suspension 12 which is a mechanical filter is bonded to the bobbin 4 and the diaphragm 11.

Figure 10:
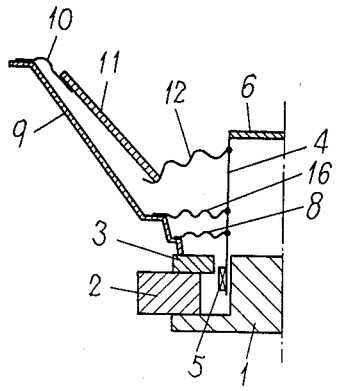
FIGS. 10 and 11 are sectional views used for the explanation of the assembly of the speakers shown in FIGS. 5 and 8.

In the final assembly line in which the bobbin 4 and the diaphragm 11 are interconnected with the suspension or mechanical filter 12, the axis of the diaphragm 11 is generally held vertical. As a result, as shown in FIG. 10, the diaphragm 11 sinks by its own weight, so that the deformations of the suspension or mechanical filter 12 are produced and consequently the diameter of the bond-line circle changes. In addition, a high pressure cannot be applied during cure, so that bonding failures tend to occur very frequently. In order to solve these problems, the suspension or mechanical filter 12 is previously bonded to the diaphragm and the bobbin is lowered from its predetermined position by a distance equal to the sinking of the diaphragm 11 so that the suspension or mechanical filter 12 may be bonded to the bobbin 4 along a predetermined bond line after the diaphragm 11 and the bobbin have been registered or aligned with each other in a proper positional relationship. Therefore, the bond line between the bobbin 4 and the suspension or mechanical filter 12 is a line contact, so that a long cure or setting time is needed in order to ensure a desired bond strength. Thus, productivity is low.

Figure 11:
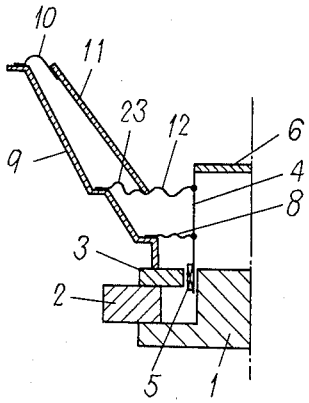

However, according to the third embodiment of the present invention as shown in FIG. 8, the lower rim of the diaphragm 11 is bonded not only to the suspension 12 but also to the second damper 23 which interconnect the bobbin 4 with the frame 9. As a result, the sinking of the diaphragm 11 due to its own weight is reduced to a minimum as shown in FIG. 11. In addition, a high pressure may be applied during cure. Furthermore, the bond line between the diaphragm 11 and the suspension 12 and the second damper 23 becomes a surface contact. As a consequence, the cure or setting time can be considerably shortened as compared with the speaker as shown in FIG. 5 or 6 in which the suspension 12 is bonded in a line-contact manner to the bobbin 4. Bonding of the suspension 12 to the bobbin 4 may take a sufficient cure or setting time in a preliminary or preparation step so as to ensure a high bond strength. Thus the overall assembly time may be considerably shortened.

As described previously, the suspension 12 can be bonded to the bobbin 4 in the preliminary or preparation step, so that when the suspension 12 is bonded to the diaphragm 11, it is not needed to register or align the bobbin 4 and the suspension 12. As a result, the number of assembly steps may be reduced.

The mass of a diaphragm in a speaker exclusively for the reproduction of low acoustic frequencies is 100 grams and more than twice as large as that of a diaphragm in a conventional speaker. As a result, the sinking of the diaphragm in the bonding step presents a serious problem as described previously, but the third embodiment as shown in FIG. 8 can solve this problem completely.

The lowest resonant frequency of a speaker exclusively for the reproduction of low acoustic frequencies must be as low as possible so that an additional mass is attached to a voice coil so as to increase its weight. In the case of the speaker of the type as shown in FIG. 5 or 6, in the final assembly line or step the suspension or mechanical filter 12 is bonded to the bobbin 4 and then an additional mass is bonded to the bobbin 4. The cure or setting time is long, so that productivity cannot be improved. To solve this problem, adhesives with a faster cure or setting time may be used, but there arises the problem that a desired bond strength cannot be obtained as described previously.

According to the third embodiment as shown in FIG. 8, however, the suspension or mechanical filter 12 can be bonded to the bobbin in the preliminary or preparation step so that no time is needed in the final assembly step for bonding the suspension 12 to the bobbin 4. The cure or setting time in bonding the additional mass to the bobbin 4 may be long so that an adhesive such as rubber adhesives which exhibits a high bond strength can be used and, therefore, the bond strength of the additional mass can be increased.

In the case of the speaker of the type as shown in FIG. 5 or 6, three parts 8, 12 and 16 must be bonded in the final assembly step, but according to the third embodiment of the present invention shown in FIG. 8, it suffices to bond only two parts; that is, the first damper 8 and the suspension or mechanical filter 12, so that productivity can be further improved.

It is, of course, possible to make the suspension or mechanical filter 12 and the second damper 23 into a unitary construction. Alternatively, they may be interconnected to each other by use of a suitable adapter. In the latter case, the lower rim of the diaphragm 11 may be bonded through an adapter to the suspension 12 and the second damper 23.

(c) Frequency Response:

In the case of the speaker of the type as shown in FIG. 5 or 6, the first damper 8 and the second damper (or mechanical filter) 16 are hardened in order to minimize rolling, but there arises the problem that the lowest resonant frequency becomes higher because the lowest resonant frequency is substantially determined by the masses of the first damper 8, the second damper (or mechanical filter) 16 and the voice coil 5.

However, according to the third embodiment of the present invention shown in FIG. 8, the first damper 8 may be softened sufficiently and no problem will arise even when the second damper 23 is hardened or made stiff more or less. As a result, the lowest resonant frequency may be lowered. The reason is as follows. The compliances of the edge 10, the second damper 23 and a cabinet are in parallel in an equivalent circuit. In general, the compliance of the cabinet dominates eventually. Especially, in the case of a small cabinet, the compliance of the air in the cabinet is low, so that the compliance of the second damper 23 hardly affects the frequency-response characteristic.

It is to be understood that bonding of the second damper 23 is not limited to the lower rim of the diaphragm and that it may be bonded at any position. However, it is, of course, apparent that the more the bonding line is moved away from the edge, the better effects or results can be attained. In order to minimize rolling, it is preferable that the center of rolling coincides with the center of gravity of the diaphragm.

So far the present invention has been described in conjunction with the speakers provided with an air suspension, but it is to be understood that the present invention may be equally applied to the speakers in which the diaphragm tends to be displaced in the directions except its axial direction. For instance, in the case of a speaker of the type in which a corrugated damper is used as a mechanical filter, a second damper may be interposed between a frame and a diaphragm, whereby rolling and "gap rubbing" may be substantially eliminated.

Figure 12:
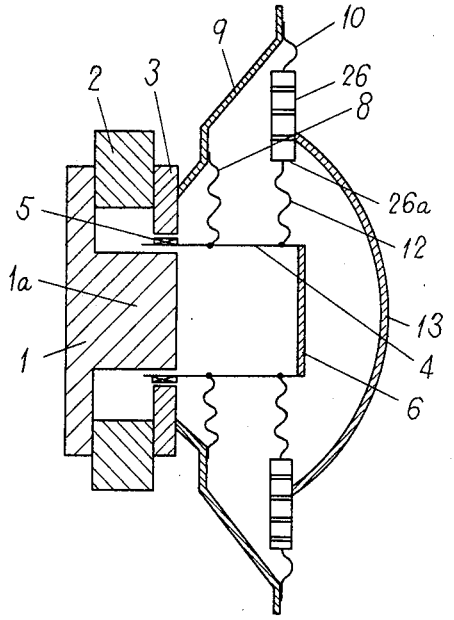
FIG. 12 is a sectional view of a fifth embodiment of the present invention.

In the fifth embodiment the present invention is applied to a speaker with a flat diaphragm as shown in FIG. 12. Even when a speaker is designed and constructed as shown in FIG. 8, the position of the helical coiled spring 19 which corresponds to the mechanical filter, the pivotal point 21 corresponding to the edge 10 and the position of the mass 22 of the diaphragm are different from each other as long as a cone-shaped diaphragm is used. As a result, the distance $(l_3+l_4)$ in Eqs. (3) and (4) will not become zero, so that the reduction of the displacement x given by Eq. (3) is limited.

However, according to the fifth embodiment shown in FIG. 12, the distance $(l_3+l_4)$ is reduced to zero, so that the coefficient of $K_2$ may be increased indefinitely and consequently the displacement x of the voice coil bobbin 4 may be further reduced.

Those parts whose functions are similar to those of parts already shown and explained in conjunction with the third embodiment shown in FIG. 8 are designated by similar reference numerals and the explanation thereof shall not be made. The fifth embodiment has flat diaphragm 26 of a honeycomb construction which has a center circular aperture **26*a* which is closed with a dust cap 13. The mechanical filter or suspension 12 is interposed between the outer cylindrical wall surface of the bobbin 4 and the inner rim of the aperture 26*a***.

When the flat diaphragm 26 is used, $(l_3+l_4)$ in Eq. (3) becomes zero, so that the coefficient of $K_2$ is permitted to increase indefinitely. As a result, as compared with the speakers having a cone-shaped diaphragm, the displacement x due to the external force f can be reduced to a minimum and subsequently there may be provided a speaker in which the diaphragm 26 and the bobbin 4 exhibit high resistance against flexure.

It is preferable that the bond lines between the edge 10 and the suspension or mechanical filter 12 on the one hand and the flat diaphragm 26 on the other hand be as close as to the plane containing the center of gravity of the flat diaphragm 26. However, if the mass of the dust cap 13 is not negligible relative to that of the diaphragm 26, the bond lines are preferably as close to the plane containing the resultant center of gravity of the diaphragm 26 and dust cap 13 as possible. It is, of course, possible to interconnect between the bobbin 4 and the suspension or mechanical filter 12 with a suitable adapter.

In the fifth embodiment the air-tight chamber or air suspension is used as a mechanical filter as shown in FIG. 12, but it is apparent that even when the cap 6 is removed so that only the suspension 12 is used as a mechanical filter, $(l_3+l_4)$ in Eq. (3) is reduced to zero. As a result, the rolling of the bobbin 4 can be substantially suppressed or eliminated.

Figure 13:
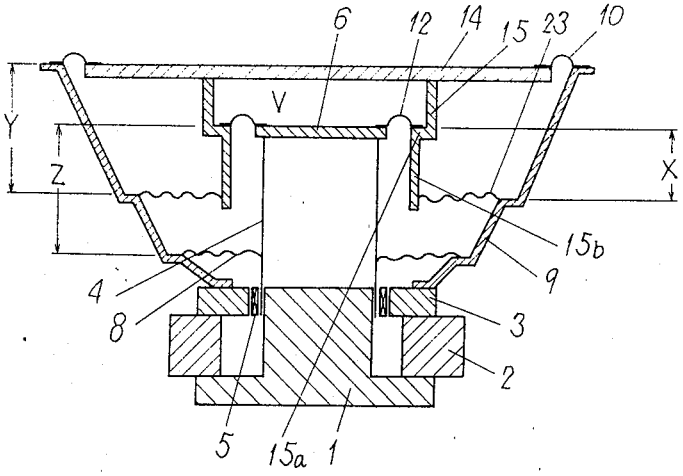
FIG. 13 is a sectional view of a sixth embodiment of the present invention.

In the sixth embodiment shown in FIG. 13, a flat diaphragm is used as in the case of the fifth embodiment described above with reference to FIG. 12 and more practical considerations are taken in selecting the position of a second damper in order to further suppress rolling. Those parts whose functions are substantially similar to those of parts shown in FIG. 12 are designated by similar reference numerals and the explanation thereof shall not be made. An adapter 15 is stepped to provide a shoulder **15*a* and a reduced-diameter portion 15*b* extended toward the voice coil 5. The second damper 23 which is substantially similar in construction to that described with reference to FIG. 8 is interposed between the lower rim of the reduced-diameter portion 15*b* of the adapter 15 and the frame 9** and bonded to them.

In order to reduce the rolling of the diaphragm 14, the arm of a moment is, in general, increased. To put in another way, the longer the distance Y between the diaphragm 14 and the second damper 23, the better. Same is true for the rolling of the voice coil bobbin 4. That is, the longer the arm of a moment; that is, the distance Z between the upper end of the bobbin 4 and the first damper 8, the better or the lesser the rolling becomes.

Therefore, as shown in FIG. 13, when the adapter 15 is provided with the downwardly extended reduced-diameter portion **15*b* so that the distance X between the suspension or mechanical filter 12 and the second damper 23 is increased, both the distances Y and Z can be increased and consequently the rollings of the diaphragm 14 and the bobbin 4** and the "gap rubbing" may be further suppressed or eliminated.

When a mechanical filter is disposed within a speaker as in the case of the present invention and if the speaker is driven with greater amplitudes, the so-called "bottoming" phenomenon that the lower or rear end of the bobbin 4 shown in FIG. 1 strikes against the upper surface of the plate 1 or the damper 8 impinges against the upper surface of the plate 3 will result. As a result, the sound reproduction characteristics are adversely affected.

The present invention solves these problems as follows. In the speaker as shown in FIG. 1, the diaphragm 11 and the voice coil bobbin 4 which is a driving system, are interconnected with the mechanical filter. Therefore, the same inventors observed the fact that if the masses of the diaphragm 11 and the voice coil bobbin 4 are suitably selected, the amplitude of vibration of the voice coil bobbin 4 can be suppressed to a minimum without causing any adverse effect on the amplitudes of vibrations of the diaphragm 11. If follows, therefore, that only the amplitude of the bobbin 4 can be reduced to a minimum while the efficiency and frequency-response characteristic remain unchanged. As a result, even when the speaker is driven with greater or stronger signals, the rear or lower end of the bobbin 4 may be prevented from striking against the plate 1. Consequently, there may be provided a speaker with a high allowable input. In addition, since the amplitude of the bobbin 4 is suppressed, its vibrations take place only in the vicinity of the halfway of the magnetic gap so that distortion of the acoustic frequency may be suppressed.

The same inventors made computer simulations and confirmed the fact if $M_1$ is the mass of a driving system and $M_2$, the mass of a diaphragm and if the following relation is satisfied $$M_1/M_2 > \tfrac{1}{4}$$

the amplitude of vibration of the voice coil bobbin can be reduced without changing the amplitudes of vibrations of the diaphragm. If the mass $M_1$ of the driving system is increased beyond the limit set by the above relation, the amplitude of the voice coil bobbin could be reduced further, but there arises a new problem that a magnet large in size must be used. Thus unlimited increase in mass $M_1$ is not permitted in practice.

Figure 14:
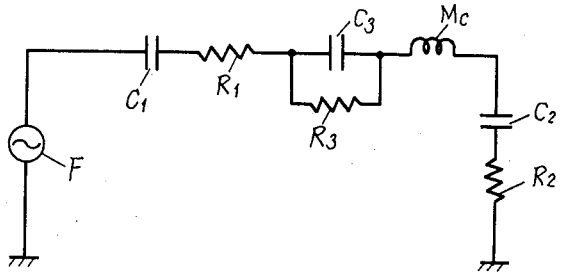
FIG. 14 is a diagram of an equivalent circuit of the first embodiment shown in FIG. 1.

The present invention also solves the problem of "bottoming" of the bobbin 4 as follows. In FIG. 14 is shown an equivalent circuit of the speaker of type as shown in FIG. 1. F represents the driving force of the voice coil 5; $C_1$, the compliance of the damper 8; $R_1$, the mechanical resistance of the damper 8; $M_c$, the mass of a vibration system; $C_2$, the compliance of the edge 10; $R_3$, the mechanical resistance thereof; $C_3$ and $R_3$, the compliance and mechanical resistance of the air damper.

It is assumed that the bobbin 4 of the speaker shown in FIG. 1 be not provided with the apertures 7. Then, the interior of the bobbin 4 whose upper end is closed with the cap 6 is communicated with the surrounding atmosphere only through the narrow magnetic gap at the lower end. Therefore, the bobbin 4 may be considered to be substantially air-tight.

In the case of DC; that is, if the bobbin 4 is vibrated gently, the air in the bobbin 4 leaks to the exterior through the annular space between the bobbin 4 and the center pole 1*a* and then through the annular space between the voice coil 5 and the plate 3. This will be explained with reference to the equivalent circuit as shown in FIG. 14. The mechanical resistance $R_3$ of the air damper is small at low frequencies, so that $C_3$ is short circuited. In practice, the annular spaces between the bobbin 4 and the center pole 1*a* and between the bobbin and the plate 3 are less than 0.5 millimeters, so that the air resistance $R_3$ is high and is in proportion to the velocity of the leaking air. Therefore, from a standpoint of AC; that is, when the air velocity is high (that is, at high frequencies), $R_3$ increases, so that the compliance $C_3$ of the air damper is not short-circuited.

As described previously, the air resistance $R_3$ is in proportion to the velocity of the air, so that when the input signal is high, $R_3$ is considerably increased and consequently the air damper exhibits greater spring forces. As a result, the problem that the voice coil bobbin 4 is vibrated excessively and strikes against the center pole 1*a* is solved. Especially when the speaker as shown in FIG. 1 is housed in a bass-reflex enclosure, the amplitudes of the voice coil 5 or the bobbin 4 at the frequencies lower than the lowest resonant frequency are higher in general by 10–20 dB as compared with the case when the speaker is disposed within a totally enclosed enclosure. Thus, the effects of the air damper are very advantageous.

Referring still to FIG. 1, the apertures 7 of the bobbin 4 may be so perforated that when the bobbin 4 is driven with high amplitudes, they are in opposed relationship with the center pole 1*a*, but when the bobbin 4 is driven with small amplitudes, they are spaced away from the center pole 1*a* upwardly thereof. Then, at low amplitudes the interior of the bobbin 4 is communicated through the apertures 7 with the surrounding atmosphere, so that the air within the bobbin 4 will not exert any damping force to the bobbin 4. On the other hand, when the bobbin 4 is driven with high amplitudes, the apertures 7 are brought to the positions opposing the center pole 1*a* and covered by it so that the interior of the bobbin 4 becomes substantially air-tight. As a result, the air within the bobbin 4 exerts high damping forces to the bobbin 4 so that the rear or lower end of the bobbin 4 is prevented from striking against the plate 1.

A speaker with a mechanical filter is disposed in an enclosure so as to provide a speaker system. In this case, the efficiency of the speaker system can be increased at the reproduced acoustic frequencies by increasing the factor of sharpness of resonance Q at both the lowest resonant frequency $f_o$ and the upper cutoff frequency $f_H$ as will be described below with reference to FIG. 15.

Figure 15:
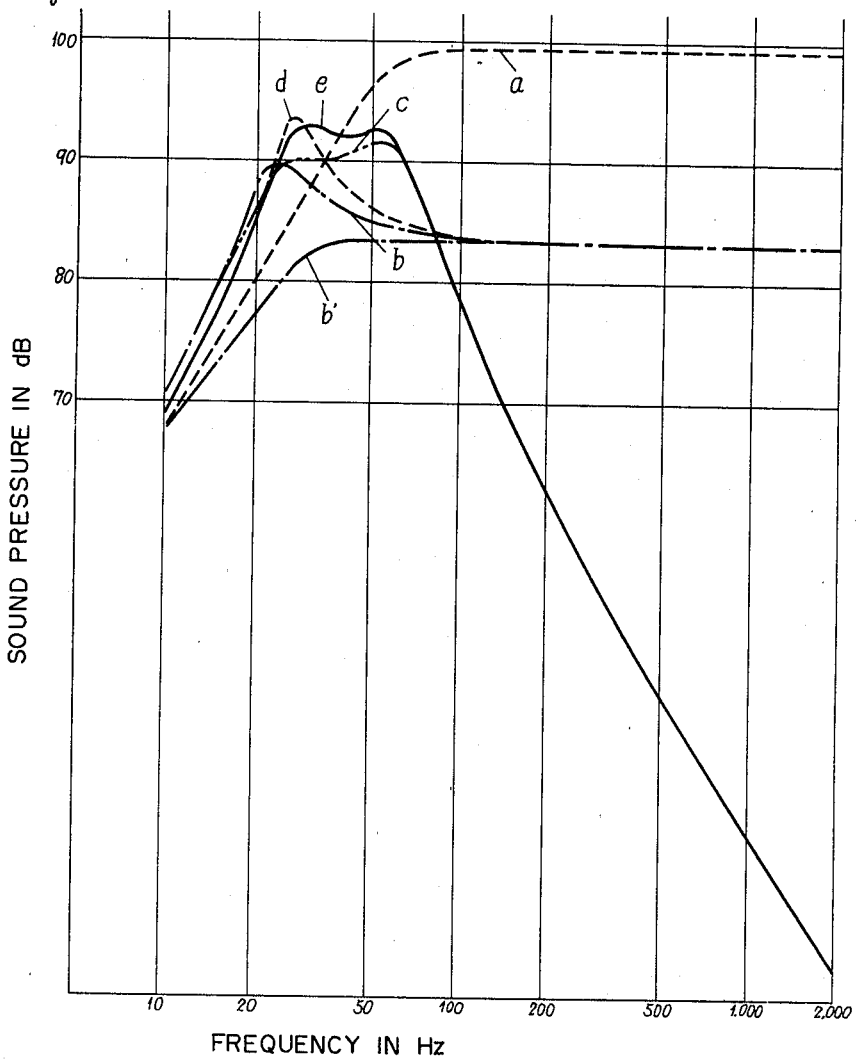
FIG. 15 shows frequency-response curves of the speakers of the present invention and the prior art which are disposed within the speaker boxes or cabinets.

In FIG. 15 are shown the frequency response curves of speaker systems. The curve a indicates the characteristic of a system in which a conventional speaker not provided with a mechanical low-pass filter is disposed in a totally closed enclosure in such a way that "flat max" may be obtained at low frequencies. "Flat max" refers to the characteristic that the flat curve a is extended from high frequencies to low frequencies and drops in the vicinity of the lowest resonant frequency $f_o$ in such a way that the factor of sharpness of resonance Q is neither increased or decreased.

The factor of sharpness of resonance $Q_o$ at the lowest resonance frequency $f_o$ is given by Eq. (7).

$$Q_o = \sqrt{M/C_B} \tag{7}$$

where

M: the mass of a vibration system, and $C_B$: the compliance of an enclosure.

Therefore, if the mass of the vibration system of a speaker such that the mass of its diaphragm is increased under the conditions that the frequency characteristic curve a may be obtained, the factor of sharpness of resonance $Q_o$ at the lowest resonant frequency $f_o$ can be increased. However, it should be noted that the efficiency is decreased in proportion to the increase in the mass of the vibration system, so that the characteristic curve b is obtained. It is seen that the curve b shows that the factor of sharpness of resonance $Q_o$ at the lowest resonant frequency $f_o$ is higher as compared with "flat max" b'. As is seen from Eq. (7), the factor of sharpness of resonance Q at the lowest resonant frequency $f_o$ may be increased by decreasing the compliance $C_B$ of the enclosure instead of increasing of the mass M of the driving system.

When the speaker is provided with the mechanical filter as shown in FIG. 1, the latter serves as a low-pass filter, so that the frequency response is damped at high frequencies, so that the characteristic curve as indicated by c is obtained.

The factor of sharpness of resonance $Q_H$ at the upper cutoff frequency $f_H$ of a mechanical filter (or a low-pass filter) is given by Eq. (8).

$$Q_H = \sqrt{M/C_F} \tag{8}$$

where

M: the mass of a vibration system, and $C_F$: the compliance of a filter.

From Eq. (8) it is quite apparent that the factor of sharpness of resonance $Q_H$ increases with increase in the mass M of the vibration system and becomes higher than "flat max". From Eq. (8) it is also apparent that the factor of sharpness of resonance $Q_H$ at the upper cutoff frequency $f_H$ is increased by decreasing the compliance $C_F$ of the filter.

Since the compliance $C_F$ must be decreased in order to attain a high cutoff frequency $f_H$, the factor of sharpness of resonance $Q_H$ increases naturally.

As described above, the factor of sharpness of resonance $Q_o$ at the lowest resonant frequency $f_o$ may be increased by suitably selecting the mass M of a vibration system and the compliance $C_B$ of a speaker enclosure while the factor of sharpness of resonance $Q_H$ at the upper cutoff frequency $f_H$ may be increased by suitably selecting the compliance $C_F$ of a filter. Therefore, a narrow frequency response range as indicated by c in FIG. 15 may be obtained and the efficiency may be improved as compared with the "flat max" b'.

When a speaker capable of attaining the frequency characteristic curve as indicated by b in FIG. 15 is housed in a bass reflex type enclosure or a drone-cone type speaker enclosure, the frequency response curve as indicated by d is obtained. When a speaker capable of attaining the frequency characteristic curve as indicated by c is housed in a bass reflex type speaker enclosure or a drone-cone type speaker enclosure, the frequency-response curve as indicated by e is obtained. Thus, a high-efficiency speaker system can be provided if a bass reflex or drone-cone type speaker enclosure is used.

The results of the mathematical analyses made by the same inventor confirmed the fact that if the cutoff frequency of a mechanical filter is set to three to four times as high as the lowest resonant frequency obtained when a speaker is housed in a totally closed speaker enclosure, the acoustic output may be raised by a few dB, but when the cutoff frequency is set to exceed five times of the lowest resonant frequency, the acoustic output will not increase notably, so that in view of the practical effects, it is preferable to set the cutoff frequency to a value less than five times the lowest resonant frequency.

POSSIBILITY OF INDUSTRIAL UTILIZATION:

As described above, according to the present invention, an air-tight space or chamber is defined within a speaker and is used as a mechanical filter. As a result, the compliance of the mechanical filter can be made independent on fatigue of a suspension which serves as the mechanical filter. Therefore, the present invention can attain the excellent effects or advantages that even when the speaker is operated for a long time period so that the suspension is subjected to fatigue, the filter characteristics remain unchanged and the range of reproduced acoustic frequencies also remains unchanged. In addition, the air-tight space or chamber is defined within the speaker itself not in its enclosure, so that the overall structure of the speaker or the speaker system can be made simplified and compact and subsequently the cost savings can be attained. Furthermore, according to the present invention, a second damper is interposed between the diaphragm and frame, so that the rolling phenomenon can be reduced to a minimum. Moreover, the air-tight interior of the bobbin serves to positively prevent the rear or lower end of the bobbin from striking against the plate.

What is claimed is:

1. A speaker of the type comprising a first plate with a center pole, a magnet mounted on said first plate, a second plate mounted on said magnet, a voice coil bobbin disposed in such a way that a voice coil mounted on the peripheral cylindrical wall of said bobbin is placed in the magnetic gap defined between said center pole of said first plate and said second plate and a diaphragm supported between said voice coil and a frame so as to be driven in response to the vibrations of said voice coil bobbin, characterized in that said voice coil bobbin and said diaphragm are interconnected through an air-tight space which is used as a mechanical filter, whereby the reproduced acoustic frequencies are limited within a predetermined range.

2. A speaker as set forth in claim 1 further characterized in that said diaphragm is a cone-shaped diaphragm, and said air-tight space is defined by said voice coil bobbin, a cap which closes the upper end of said voice coil bobbin, a suspension interconnecting between said voice coil bobbin and said diaphragm and a dust cap which partially covers said cone-shaped diaphragm at the midway between the upper and lower rims thereof.

3. A speaker as set forth in claim 1 further characterized in that said diaphragm is a flat diaphragm, and said air-tight space is defined by said voice coil bobbin, a cap which closes the upper end of said voice coil bobbin, an adapter mounted on the undersurface of said flat diaphragm and a suspension interconnecting between said voice coil bobbin or said cap thereof and said adapter.

4. A speaker as set forth in claim 1
further characterized in that
the mass $M_1$ of a driving system and the mass $M_2$ of said diaphragm are so selected as to satisfy the relation of $M_1/M_2 > \frac{1}{4}$ 5. A speaker as set forth in claim 1
further characterized in that
the air is so confined in the interior of said voice coil bobbin that its leakage in an AC manner is avoided.

6. A speaker as set forth in claim 3
further characterized in that
a projection is extended from the rear end of said adapter toward said voice coil and is connected to said frame with a second damper.

7. A speaker as set forth in claim 5
further characterized in that
the peripheral cylindrical wall of said voice coil bobbin is formed with a plurality of apertures in such positions that when said voice coil bobbin is driven with high amplitudes, said apertures are brought to the positions in opposed relationship with the outer peripheral cylindrical wall surface of said center pole of said first plate, whereby said apertures are covered by said center pole of said first plate.

8. A speaker of the type in which a diaphragm is supported between a voice coil and a frame or its equivalent member and the vibrations of said voice coil bobbin are transmitted to said diaphragm through a mechanical filter,
characterized in that
said diaphragm and said frame or its equivalent member is interconnected to each other with a second damper.

9. A speaker of the type comprising a flat diaphragm and a voice coil bobbin for driving said flat diaphragm,
characterized in that
said flat diaphragm is formed with a center aperture, and
a suspension which functions as a mechanical filter interconnects between the rim of said center aperture of said flat diaphragm and the outer peripheral cylindrical wall surface of said voice coil bobbin.

10. A speaker system of the type in which a speaker provided with a mechanical filter is disposed in a speaker enclosure,
characterized in that
the mass of a vibration system of said speaker and the compliance of said speaker enclosure are so selected and the cutoff frequency of said mechanical filter is so selected at a value less than five times the lowest frequency obtained when said speaker is disposed within a totally closed speaker enclosure that the factor of sharpness of resonance $Q_o$ of the frequency response characteristic at the lowest resonant frequency becomes higher than "flat max", and
the mass of said vibration system of said speaker and the compliance of said mechanical filter are so selected that the factor of sharpness of resonance $Q_H$ of the frequency response characteristic at said cutoff frequency becomes higher than "flat max".

* * * * *